US005679162A

United States Patent [19]

Caffrey et al.

[11] Patent Number: 5,679,162

[45] Date of Patent: Oct. 21, 1997

[54] APPARATUS FOR SELECTIVELY METERING DRESSING ONTO A BOWLING LANE SURFACE

[75] Inventors: Stephen F. Caffrey, Arvada; Ronald L. Smith, Boulder; Leonid Feldman, Broomfield, all of Colo.

[73] Assignee: AMF Bowling, Inc., Golden, Colo.

[21] Appl. No.: 618,256

[22] Filed: Mar. 18, 1996

Related U.S. Application Data

[62] Division of Ser. No. 337,945, Nov. 10, 1994, Pat. No. 5,517,709.

[51] Int. Cl.[6] ..... B05C 1/00

[52] U.S. Cl. ..... 118/684; 118/207; 118/244; 118/255; 118/258; 118/264; 118/304; 15/98; 15/103.5

[58] Field of Search ..... 15/98, 103.5; 118/207, 118/244, 255, 258, 259, 264, 304, 684, 266

[56] References Cited

U.S. PATENT DOCUMENTS

| | | | |
|---|---|---|---|
| 2,712,297 | 7/1955 | McGrew | 118/234 |
| 3,217,347 | 11/1965 | Domecki . | |
| 4,246,674 | 1/1981 | Ingermann et al. | 15/4 |
| 4,700,427 | 10/1987 | Knepper | 15/4 |
| 4,766,016 | 8/1988 | Kubo | 427/428 |
| 4,959,884 | 10/1990 | Ingermann et al. | 15/302 |
| 4,980,815 | 12/1990 | Davis | 364/479 |
| 5,161,277 | 11/1992 | Ingermann et al. | 15/98 |
| 5,181,290 | 1/1993 | Davis et al. | 15/93 |
| 5,185,901 | 2/1993 | Davis et al. | 15/98 |
| 5,243,728 | 9/1993 | Smith et al. | 15/98 |
| 5,274,871 | 1/1994 | Smith et al. | 15/98 |

FOREIGN PATENT DOCUMENTS

| | | | |
|---|---|---|---|
| 937005 | 11/1973 | Canada | 15/73 |

*Primary Examiner*—Laura Edwards
*Attorney, Agent, or Firm*—Fields & Johnson, P.C.

[57] ABSTRACT

An apparatus applies dressing fluid to a bowling lane surface in a discrete pattern laterally across a plurality of zones on the bowling lane. A carriage, for movement along a bowling lane, has an applicator mounted thereon for applying the dressing fluid to the bowling lane surface. Dressing fluid is supplied from a reservoir by a plurality of pulse valves which supply the dressing fluid to a plurality of fluid dispersion chambers, each having an inlet connected to one of the pulse valves and having an outlet positioned to apply dressing fluid to the applicator. The outlet has a width equal to the width of one of the zones. A controller is provided for selectively activating each of the pulse valves to discharge a discrete amount of fluid dressing into each dispersion chamber. Each zone may be the width of one board across the bowling alley so that different discrete amounts of oil can be applied to each board. A method is provided to supply discrete amounts of bowling lane dressing to each of a plurality of zones wherein each zone is one board width or portion of a board width.

10 Claims, 9 Drawing Sheets

80
78
74
82
80
90
76
82
190
74
86
71
82
72
86
71

60
56
SUPPLY
61
68
FILTER
63
64
66
62
65
92
CONTROLLER
12 39
0000 0000
94

67
48
69
70
71
74
72

APPARATUS FOR SELECTIVELY METERING DRESSING ONTO A BOWLING LANE SURFACE

This application is a division of application Ser. No. 08/337,945, filed Nov. 10, 1994 now U.S. Pat. No. 5,517,709.

TECHNICAL FIELD

This invention relates to an apparatus for applying lane dressing to a bowling alley and more particularly to an apparatus for selectively applying different amounts of lane dressing to each individual board across a bowling alley.

BACKGROUND ART

Many types of bowling lane maintenance machines have been developed for the purpose of applying bowling lane dressing to a bowling alley in a predetermined lateral pattern across the alley. In many cases, the apparatus which was developed was done so in response to rules laid down by the American Bowling Congress. As these rules have changed, different lane maintenance machines, which will better accommodate new rules, have been developed. Under current rules, virtually any lane dressing application pattern is permissible. Therefore, it is desirable to have a lane maintenance machine which can put lane dressing down across an alley in virtually any desired pattern. Prior art devices have been developed which provide some variation in the application of the oil pattern across the bowling lane, but none provide complete versatility.

Ingermann et al. U.S. Pat. No. 4,959,884 provides an oil transfer device for transferring lane dressing from a reservoir to an applicator roller. The device includes pressure fingers which can be adjusted to vary the amount of oil transferred from the reservoir to a transfer roller by a wick. For any given pressure across the transfer roller, the amount of oil applied from the transfer roller to the applicator roller is strictly a function of the speed of the transfer roller.

Davis U.S. Pat. No. 4,980,815 discloses a lane maintenance machine which has a plurality of discharged heads which are each movable laterally across a portion of the apparatus and each discharge head includes a discharge pencil for discharging a predetermined amount of lane dressing onto the transfer roller as the discharge head moves across a portion of the apparatus. This device is intended to provide precise control of application of lane dressing to each portion of the transfer roller and to provide controlled variable amounts of lane dressing across each portion. However, it cannot vary the amount of lane dressing incrementally from one board of the bowling alley to the next.

Ingermann et al. U.S. Pat. No. 5,161,277 provides a variable speed transfer roller for applying lane dressing from the reservoir to the applicator roller. By varying the speed of the transfer roller, the amount of dressing applied across the applicator roller can also be varied. However, the change is uniform clear across the applicator roller and hence across the bowling lane.

Davis U.S. Pat. No. 5,181,290 discloses an apparatus for applying lane dressing in which the reservoir has a plurality of wicks extending from the top thereof each of which can be selectively controlled to bring them into and out of contact with the transfer roller to apply lane dressing selectively across a distance equal to the width of each wick. This apparatus is suitable for its intended purpose but does not provide for separate application of lane dressing in predetermined amounts to each board across a bowling lane.

Smith et al. U.S. Pat. No. 5,243,728 discloses an apparatus which has a segmented transfer roller wherein each segment can be driven at different speeds. By varying the speed of the different segments, different amounts of lane dressing can be applied across different portions of the bowling alley. This apparatus is also suitable for its intended purpose but does not provide means for selectively varying the lane dressing on each board across a bowling lane.

Smith et al U.S. Pat. No. 5,274,871 discloses an apparatus which has a segmented transfer roller with a plurality of roller segments. A plurality of pivotally mounted reservoirs are provided, one reservoir corresponding in length with each roller segment and being mounted for pivotal movement to bring its wick into and out of operative contact with the respective roller segments. This arrangement provides more possible variations in the application of lane dressing to a bowling lane but still does not permit the application of different amounts of lane dressing to each individual board.

DISCLOSURE OF THE INVENTION

In accordance with the present invention, an apparatus for applying dressing fluid to a bowling lane surface in a discrete pattern laterally across a plurality of zones on the bowling lane is provided. In the most broad disclosure of this invention, a means is provided for transferring dressing fluid to the applicator wherein a selected amount of fluid flows from a fluid confining area, such as a chamber, to the applicator. A carriage, for movement along a bowling lane, has an applicator mounted across it for applying the dressing fluid to the bowling lane surface. Dressing fluid is supplied from a reservoir by means of a plurality of pulse valves which supply the fluid to a plurality of fluid dispersion chambers, each having an inlet connected to one of the pulse valves and having an outlet positioned to apply dressing fluid to the applicator. In a preferred embodiment, the outlet has a width equal to the width of one of the zones. The size of the outlet, however, may be sized to conform to the exact desired width of application wherein the outlet could span multiple zones or portions of zones. Control means is provided for selectively activating each of the pumps to discharge a discrete amount of fluid dressing into each dispersion chamber. Conveniently, each zone may be the width of one board across the bowling alley so that different discrete amounts of oil can be applied to each board.

More specifically, the reservoir supplies fluid to a manifold which in turn supplies each of the pumps. The position of the dispersion chambers is adjustable with respect to the applicator roller.

The dispersion chambers can be laterally spaced along an elongated bar. An elongated plate extends along the bar over the dispersion chambers and is attached to the bar to form a cover for the dispersion chambers.

The control means selectively varies the duty cycle of each pulse valve to vary the amount of dressing fluid supplied to each dispersion chamber to vary the amount of dressing fluid applied to each zone. The control means also determines where along the length of the bowling alley dressing fluid is applied.

The manifold can be formed in or along the elongated bar or can be a separate element mounted generally parallel thereto. The dispersion chambers and the cover plate form outlet dispersion slits through which the dressing fluid is dispensed onto the applicator roller. Conveniently, each of these dispersion chamber slits may be the same width as one or more of the boards on the bowling alley or portion of the boards. With this arrangement, there is a pulse valve for each dispersion chamber so the different amounts of oil can be applied to any board or to any portion of each board of the bowling lane. With this apparatus, virtually every conceivable variation in oil dressing application can be provided to the bowling lane proprietor and to the bowlers.

In one of the embodiments, the dispersion chambers are formed as hollowed out portions in the upper surface of the elongated bar. In another embodiment, the dispersion chambers are formed by cut out portions in a gasket between the elongated bar and the cover. In the later embodiment, diffusion means are provided in the form of diffusion baffles and a diffusion barrier formed in the gasket.

Additional advantages of this invention will become apparent from the description which follows, taken in conjunction with the accompanying drawings.

BEST MODE FOR CARRYING OUT THE INVENTION

Figure 1:
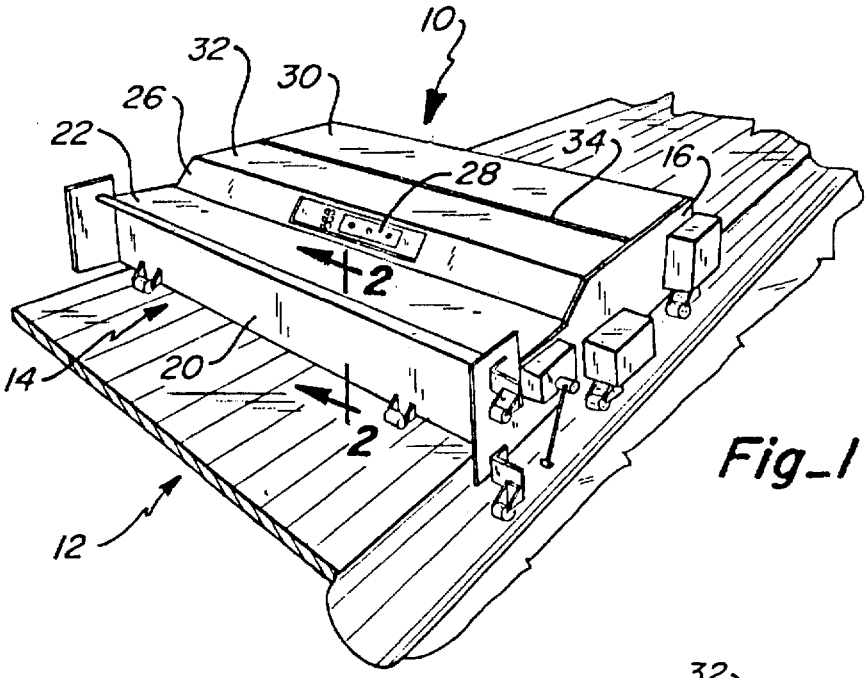
FIG. 1 is a perspective view of a bowling lane maintenance machine incorporating the present invention.
Figure 2:
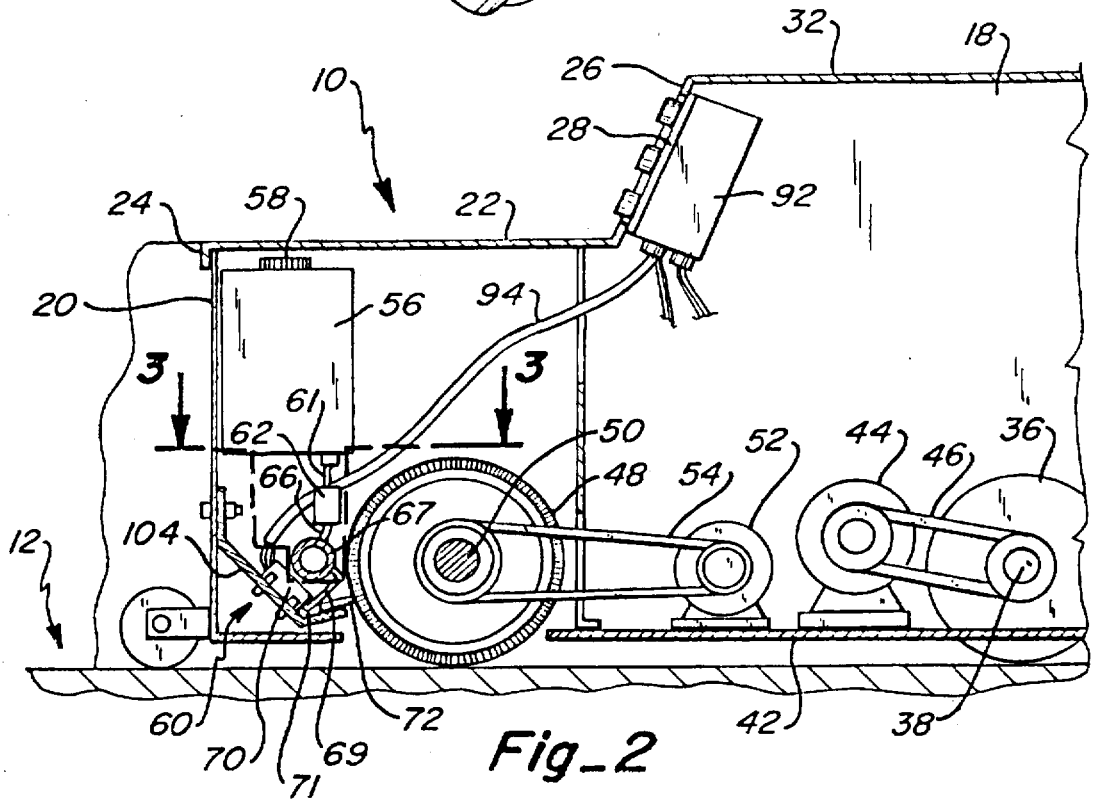
FIG. 2 is an enlarged, fragmentary vertical section, taken along line 2—2 of FIG. 1, showing the dressing fluid applying apparatus of this invention.
Figure 3:
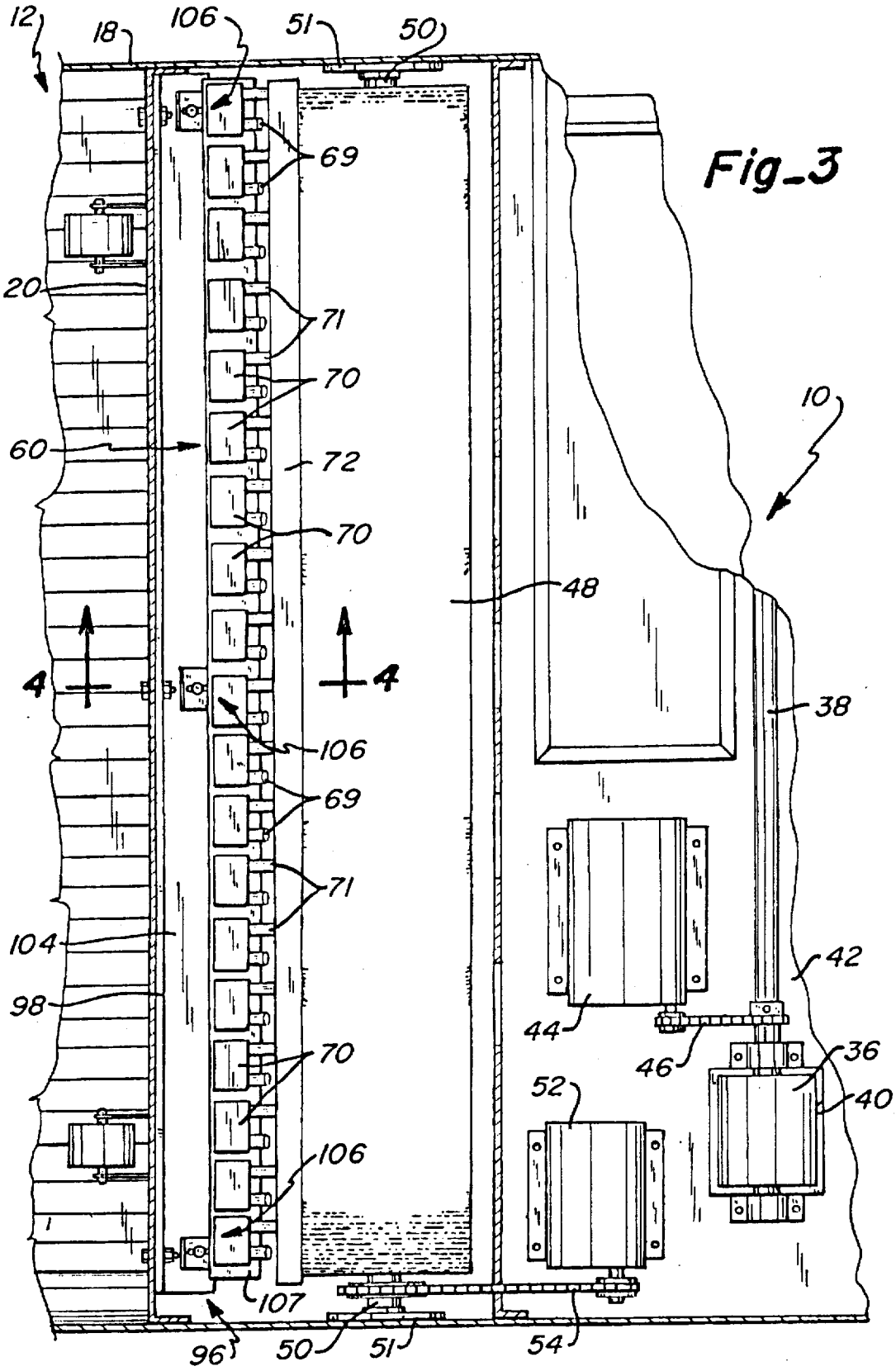
FIG. 3 is a horizontal section, taken along line 3—3 of FIG. 2, showing further details of the invention.

As seen in FIGS. 1–3, a bowling lane dressing apparatus 10 is provided for movement up and down a bowling lane 12 between the foul line and the pit. This apparatus includes a carriage 14 which includes opposite side walls 16 and 18 interconnected by a front wall 20 and a rear wall (not shown). Top cover 22 has a front flange 24 that extends over the upper edge of front wall 20 and terminates at its other side in an upstanding angular wall 26 to which a control panel 28 is mounted for controlling the various functions of the apparatus. The device has an upper cover 30 which has a pivotal section 32 connected thereto as by a panel hinge 34. A pivotal section 32 allows access to the interior of the apparatus for maintenance and repair. Details of the mechanics of this devices, other than those described below, can be found in Ingermann et al. U.S. Pat. No. 4,959,844 for "Combination Bowling Lane Stripper and Dressing Apparatus" which is incorporated herein by reference.

As best seen in FIGS. 2 and 3, carriage 14 is provided with spaced drive wheels 36 interconnected by rotatable shaft 38. The drive wheels 36 extend through openings 40 in bottom wall 42 for engagement with bowling alley 12 for moving the carriage longitudinally along the bowling alley for applying lane dressing. The drive wheels are driven by a motor 44 through a chain drive 46. The applicator or buffer roller 48 is mounted for rotation on a central shaft 50 and is position to contact the bowling alley 12 to apply the lane dressing. It is rotated by a drive motor 52 through a chain drive 54. Conveniently, a reservoir 56, shown in FIG. 2, is attached to front wall 20 and is filled with lane dressing oil through filler cap 58.

Figure 6:
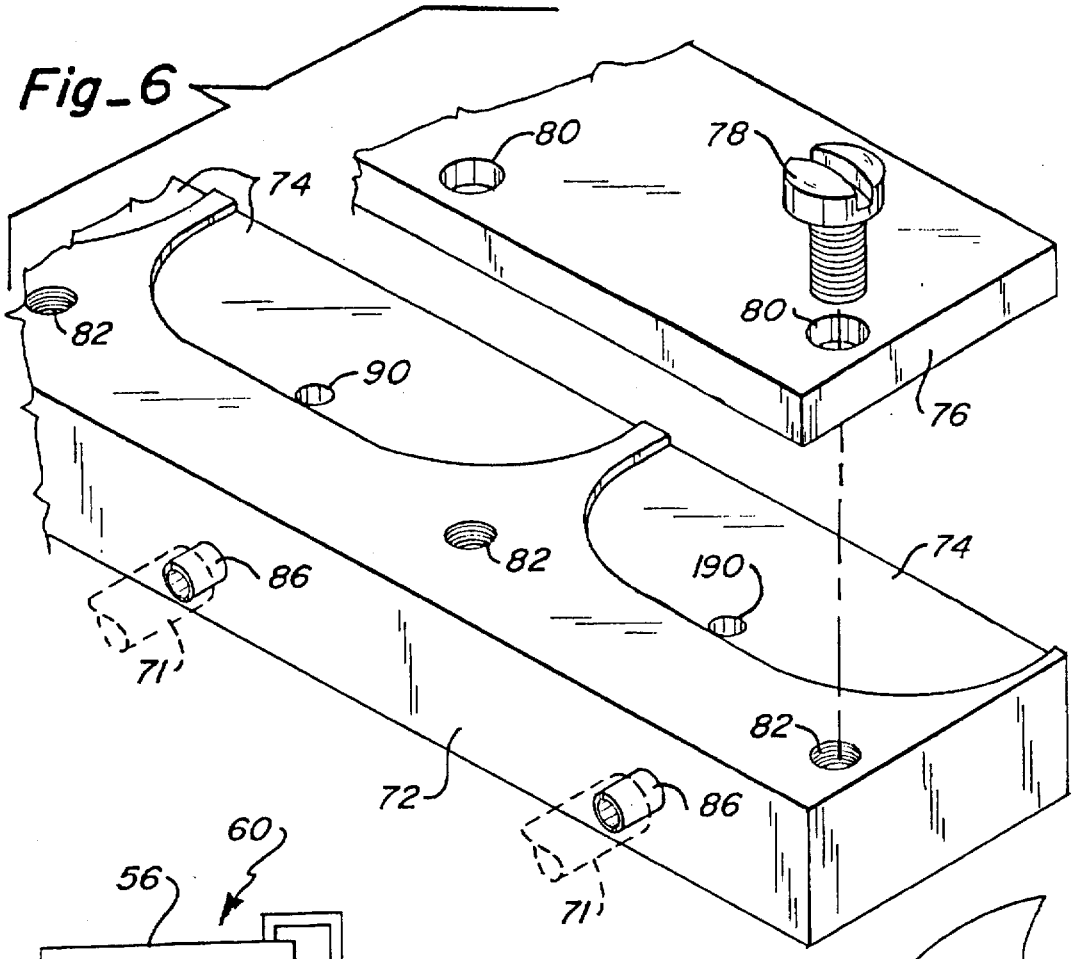
FIG. 6 is a fragmentary, exploded, perspective view of a portion of the dispersion chamber bar showing the dispersion chambers and the cover plate therefor.
Figure 7:
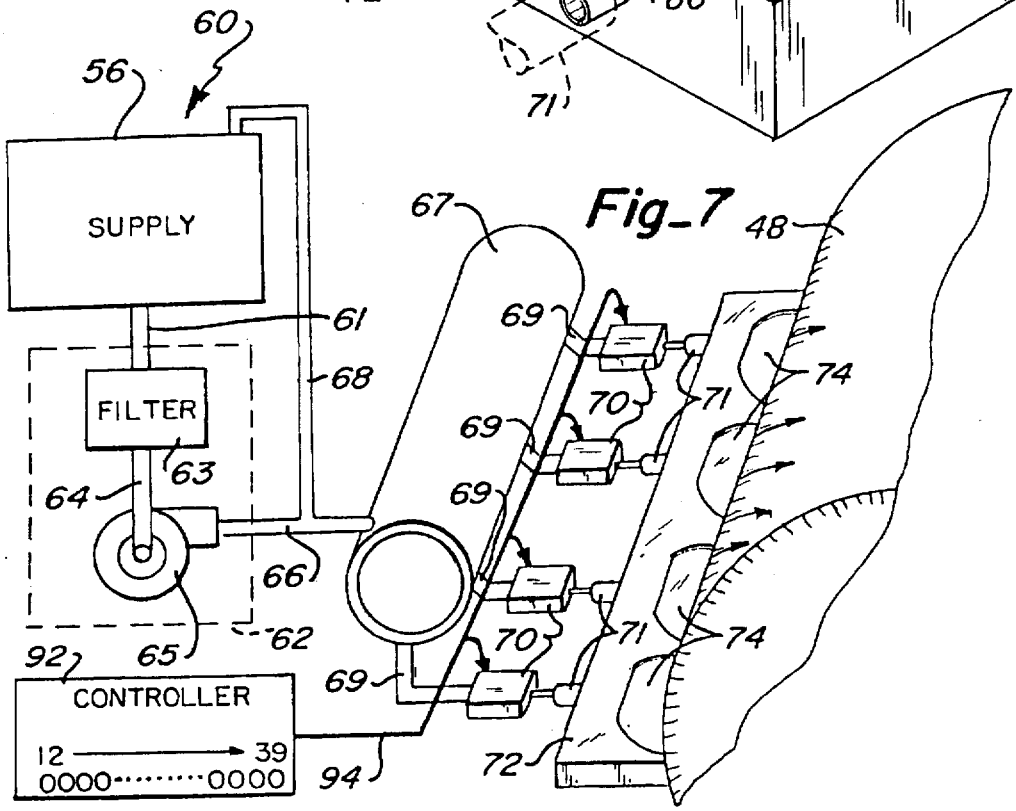
FIG. 7 is a fragmentary diagrammatical view of the fluid circuit and controller for the dressing fluid applying apparatus.

A lane dressing dispersion unit 60 is supplied with oil through a first tube 61 connecting the bottom of reservoir 56 to a pressure system 62 via filter 63, which filters out any impurities that are in the reservoir, as best seen in FIG. 7. A tube 64 connects filter 63 to pump 65 which in turn supplies oil through discharge tube 66 to manifold 67. A return line 68 is connected to reservoir 56 for returning oil that is not dispersed. The lane dressing is supplied from manifold 67 through a plurality of outlet tubes 69, each of which is connected to a separate one of a plurality of positive displacement pulse valves 70. Each pulse valve has an outlet tube 71 connected to an elongated bar 72 for supplying oil to a plurality of longitudinally spaced dispersion chambers 74 formed therealong. As best seen in FIG. 3, these dispersion chambers can be formed, as by milling. A cover plate 76 extends over elongated bar 72 and forms a cover for each dispersion chamber 74. The space between cover 76 and the bottom of dispersion chamber 74 provides an outlet slit 77 through which the bowling lane dressing fluid is discharged onto applicator roller 48. Conveniently, as seen in FIG. 6, top cover 76 is held in place by a plurality of fastening means such as screws 78 extending through holes 80 in the cover plate and into tapped holes 82 in bars 72.

Figure 4:
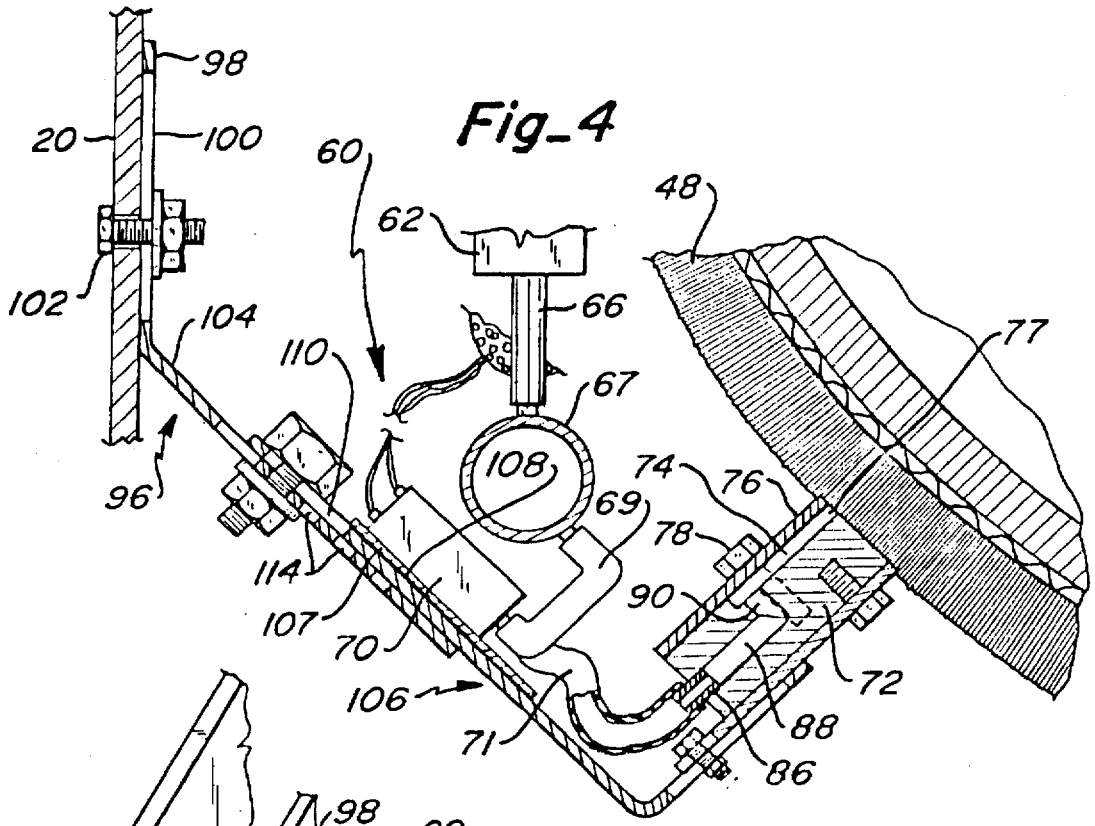
FIG. 4 is an enlarged horizontal fragmentary section, taken along line 4—4 of FIG. 3, showing details of the manifold and dispersion chamber bar.
Figure 5:
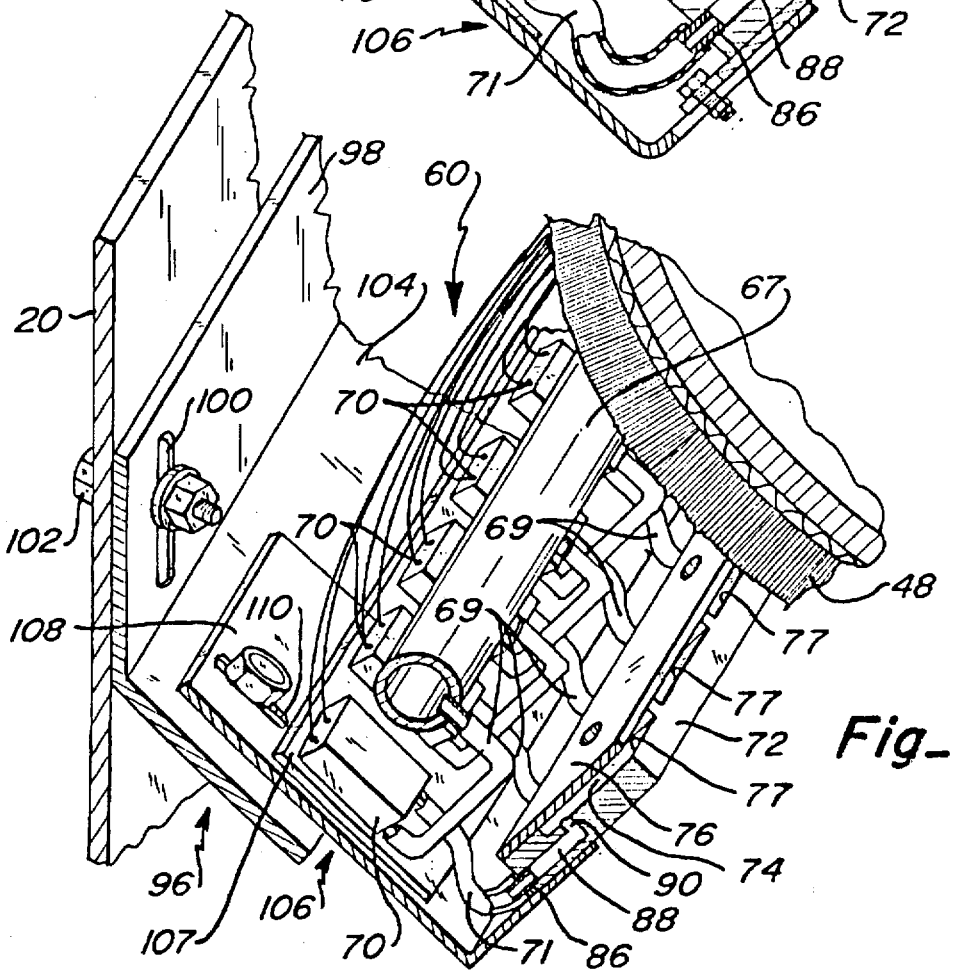
FIG. 5 is a fragmentary perspective view of the apparatus shown in FIG. 4.

Each outlet tube 71 has a distal end connected, respectively to a plurality of tubular connectors 86 which extend from lateral passageways 88 in bar 72, as seen in FIGS. 4 and 5. Each passageway 88 intersects with a vertical port 90 which terminates in dispersion chamber 74. Each pulse valve 70 is controlled by a conventional controller 92, such as a PLC, which is mounted behind control panel 28, as seen in FIG. 2, and provides suitable electrical signals through electrical wires 94 to selectively activate each individual pulse valve. The pulse valves each receive electrical pulse signals from the controller to cause each pulse valve to operate for an appropriate duty cycle to supply the desired amount of fluid to each of the dispersion chambers 74. Thus, upon activation of one of the pulse valves 70 by controller 92, the precise amount of dressing fluid is pumped through discharge conduit 71 and into the dispersion chamber via passageway 88 and port 90. This predetermined amount of fluid dressing is discharged through the outlet slit 77 and onto an applicator, such as applicator roller 48, which in turn applies the dressing to the bowling lane. Stated another way, the controller is able to vary the volummetric flow rate of dressing fluid to the respective dispersion chambers by varying the number of electrical pulses it sends to each pulse valve.

While the applicator has been illustrated as being a roller of relatively large diameter, it will be understood by one skilled in the art that other forms of applicators can be used. By way of example only, a roller having a much smaller diameter can be used or the applicator could take the form of a wick or wiper or sponge. In fact, the applicator can be any device which has the ability to transfer a predetermined amount of lane dressing from each of the dispersion chambers to individual zones or boards of the bowling lane surface.

As best seen in FIGS. 4 and 5, the dispersion unit 60 is adjustably mounted on front wall 20. In this regard, an angle bracket 96 is provided which has a vertical flange 98 with a longitudinal slot 100 therein. A bolt 102 extends through the slot and front wall to hold the bracket in vertically adjustable position. Angle bracket 96 has an angular flange 104 extending outwardly at an angle from vertical flange 98. Attached to flange 104 are a plurality of laterally spaced brackets 106 which support dispersion unit 60. Bracket 106 has an attachment arm 108 with an elongated slot 110 for receiving a bolt which extends through any one of a plurality of spaced holes 114 in flange 104 of bracket 96. It will be apparent that with this arrangement, the bar can be moved to adjust the position of the dispersion chambers with respect to the applicator roller. A support plate 107 extends between brackets 106 to support the pulse valves 70, as shown.

Figure 8:
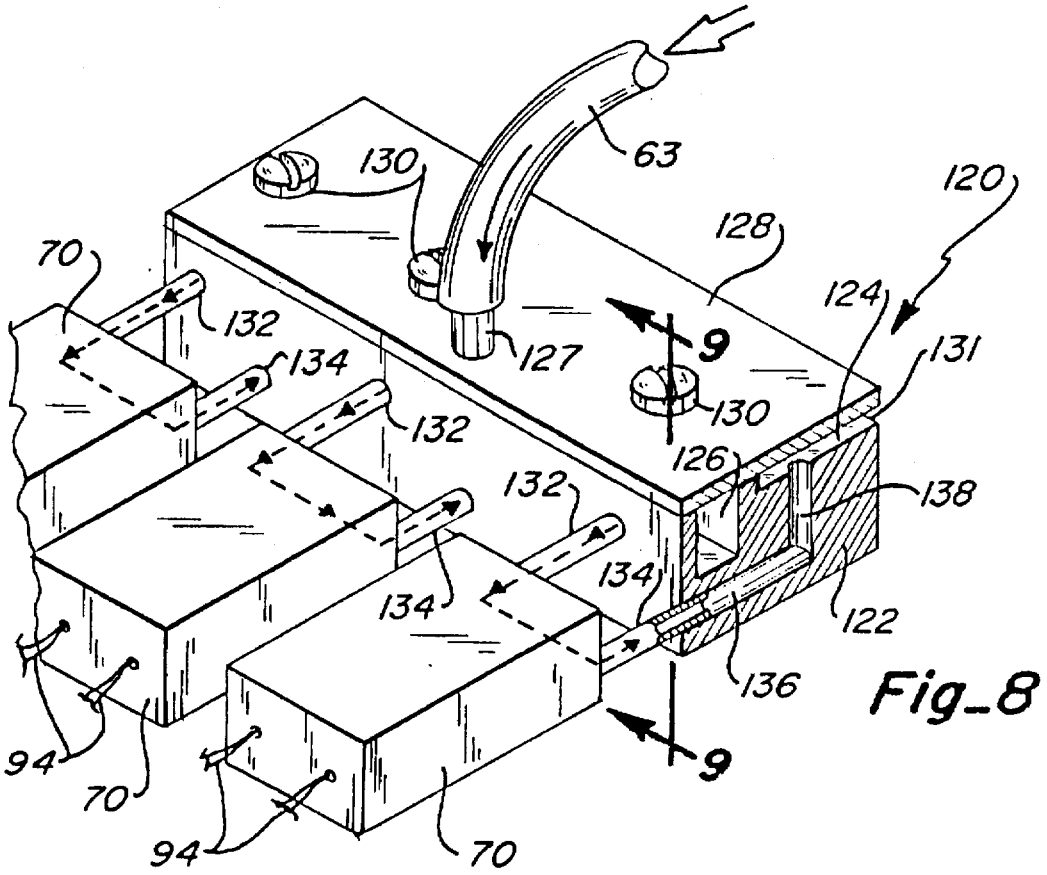
FIG. 8 is a fragmentary perspective view of an alternative dressing fluid applying apparatus.
Figure 9:
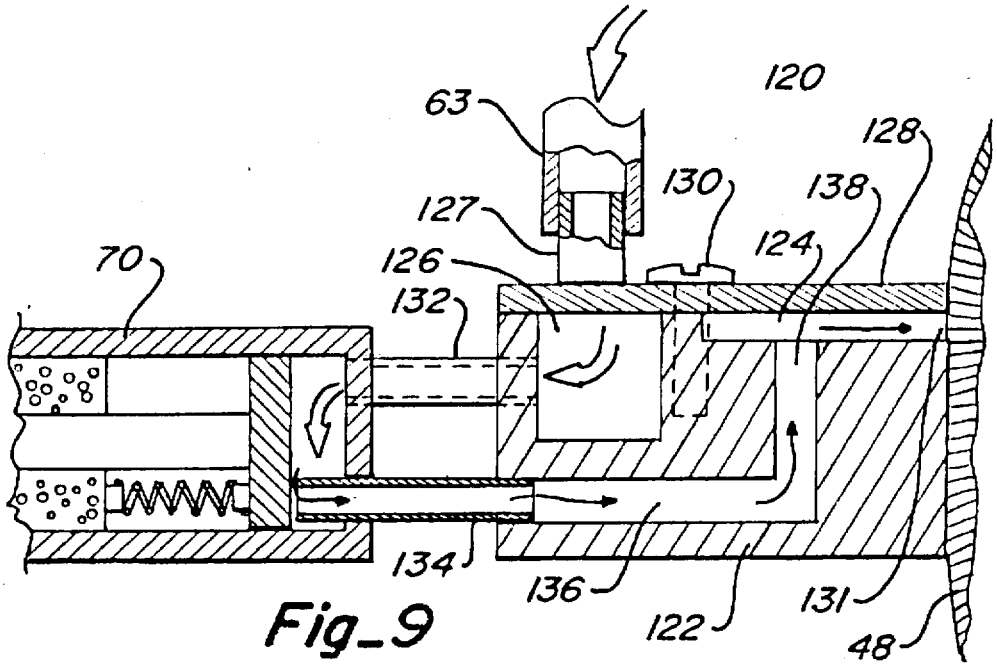
FIG. 9 is an enlarged fragmentary vertical section, taken along line 9—9 of FIG. 8, showing further details of the dressing fluid applying apparatus.

An alternative dispersion unit 120 is shown in FIGS. 8 and 9. In this dispersion unit, an elongated bar 122 includes a plurality of longitudinally spaced dispersion chambers 124. In addition, manifold 126 is formed integrally in bar 122 behind the dispersion chambers, as shown. Dressing fluid is supplied by tube 63 through an inlet tube 127 in communication with manifold 126. This tube passes through cover plate 128 which is attached over elongated bar 122 to form a cover for dispersion chambers 124 and for manifold 126. It is held in place by a plurality of laterally spaced screws 130 and forms an outlet slit 131. The fluid in manifold 26 is supplied to a plurality of pulse valves 70 by respective conduits 132. This fluid is pumped by each of the pulse valves 70 in discrete incremental amounts through respective outlet tubes 134 which communicates with passageway 136 and port 138 which conveys the fluid to dispersion chamber 124.

Figure 10:
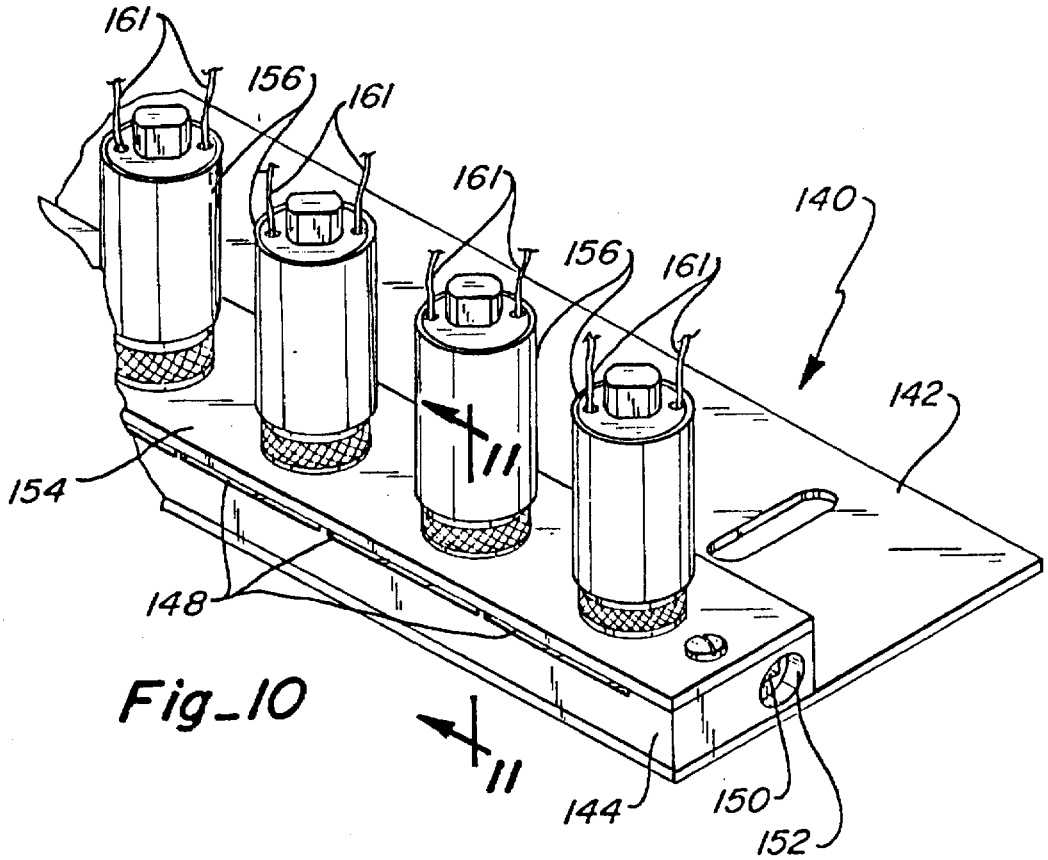
FIG. 10 is a fragmentary perspective view of a further alternative embodiment of a dressing fluid applying apparatus.
Figure 11:
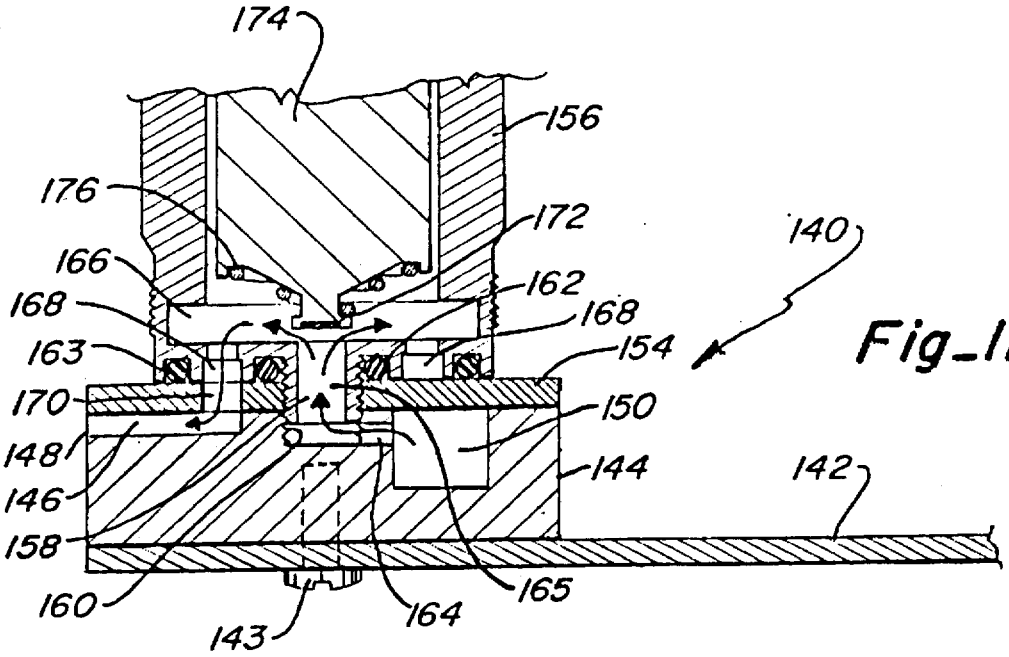
FIG. 11 is an enlarged vertical section, taken along line 11—11 of FIG. 10 showing the internal construction of a control valve.
Figure 12:
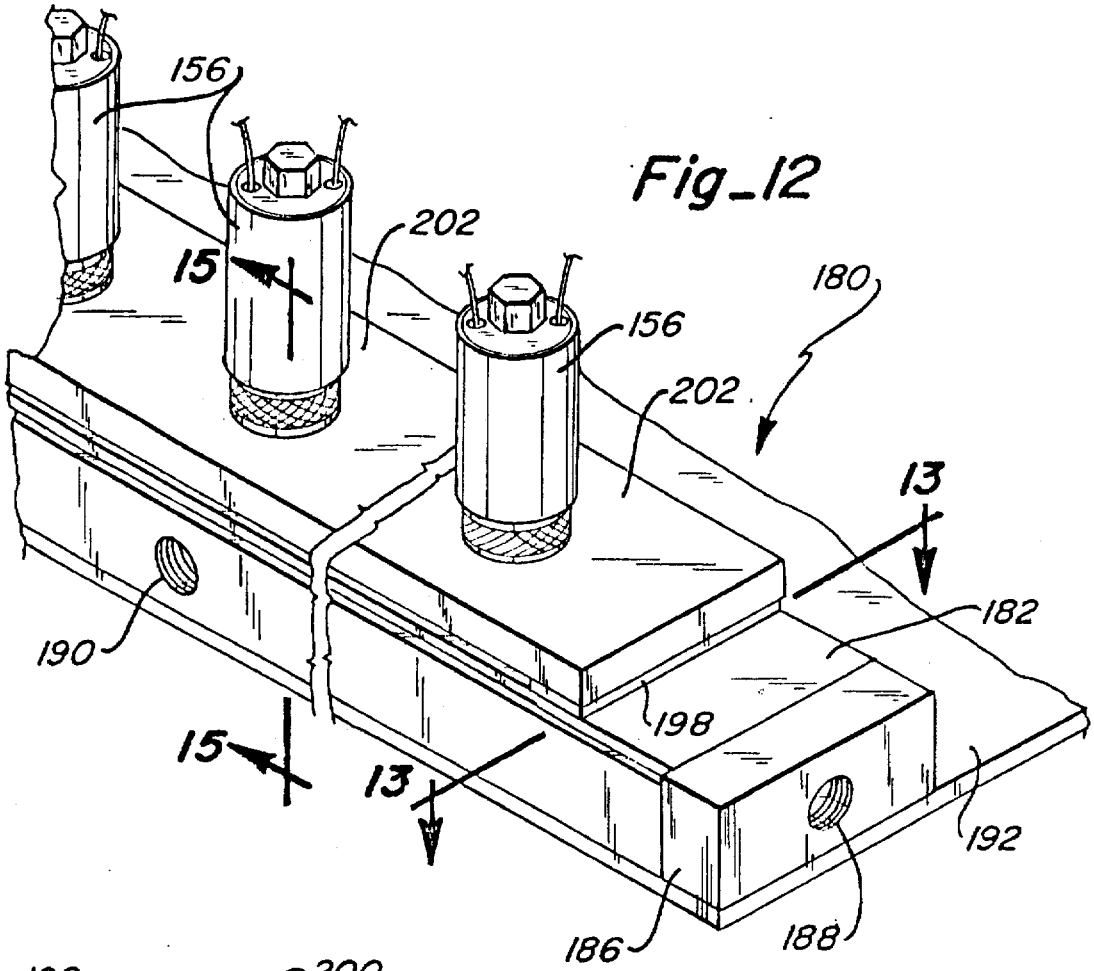
FIG. 12 is a fragmentary perspective view of a preferred embodiment of a dressing fluid applying apparatus.

A still further embodiment is shown in FIGS. 10 and 11 wherein a dispersion unit 140 is attached to a mounting bracket 142 by laterally spaced bolts, such as bolt 143 shown in FIG. 11. An elongated bar 144 extends across bracket 142 and has a plurality of laterally spaced dispersion chambers, such as dispersion chamber 146, shown in FIG. 11. In addition, manifold 150 is formed integrally in bar 144 behind the dispersion chambers, as shown. Dressing fluid is supplied through inlet 152 which can be located anywhere along manifold 150 but is shown as being at the end thereof in FIG. 10. A cover plate 154 forms a top for the dispersion chambers 146 and manifold 150 which is held in place by longitudinally spaced solenoid pulse valves 156 and forms a discharge slit 148 at the front of each dispersion chamber 146 for the dressing fluid to be transferred to the applicator roller. Conveniently, each pulse valve 156 has a threaded stem 158 which extends through top cover 154 and is secured in a tapped hole 160 in bar 144. Each pulse valve also includes a pair of electrical leads 161 for connecting it to a controller, such as controller 92 of FIG. 2. As in the previous embodiments, there is a pulse valve for each dispersion chamber. Each pulse valve has an inner O-ring 162 around stem 158 and an outer O-ring 163, as shown in FIG. 11 to prevent leakage of dressing fluid.

As will be apparent, the dressing fluid flows from manifold 150 through a plurality of lateral holes 164, each communicating with a central passageway 165 in stem 158, and into pulse valve chamber 166 when pulse valve 156 is energized so that it is moved to the open position shown in FIG. 11. The fluid is expelled from chamber 166 through one of the plurality of bottom openings 168 in the bottom of the valve which is aligned with port 170 in cover plated 154 which directs the fluid into dispersion chamber 146 at the lower end of armature 174. When pulse valve 156 is disengaged the valve seat 172 will cover the upper end of passageway 165 under the bias of spring 176 to prevent the flow of dressing oil to dispersion chamber 146. Thus, with each pulse of each pulse valve 156, a precise discreet amount of dressing oil will be supplied to the respective dispersion chambers. The duty cycle of the pulses provided by controller 92 to each pulse valve will determine the total amount of oil to be supplied from each dispersion chamber to the applicator roller 48 and transferred by the applicator roller to each board on bowling alley 12.

Figure 13:
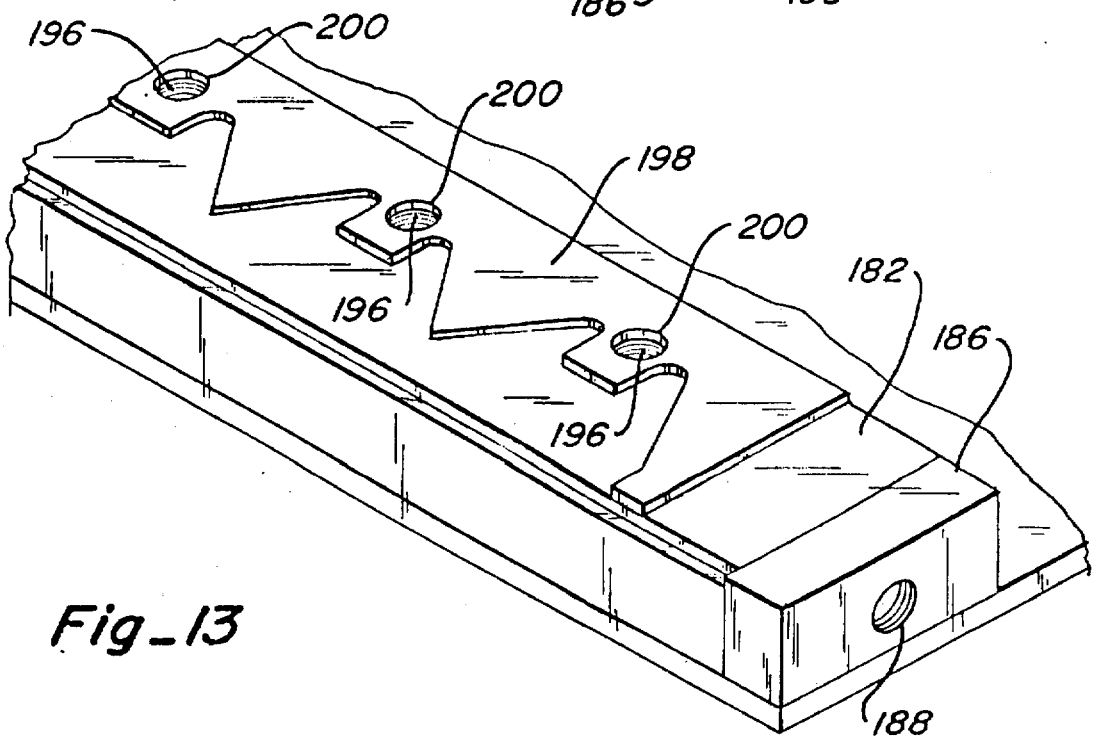
FIG. 13 is a fragmentary perspective view, taken along line 13—13 of FIG. 12, showing details of the dispersion gasket.
Figure 14:
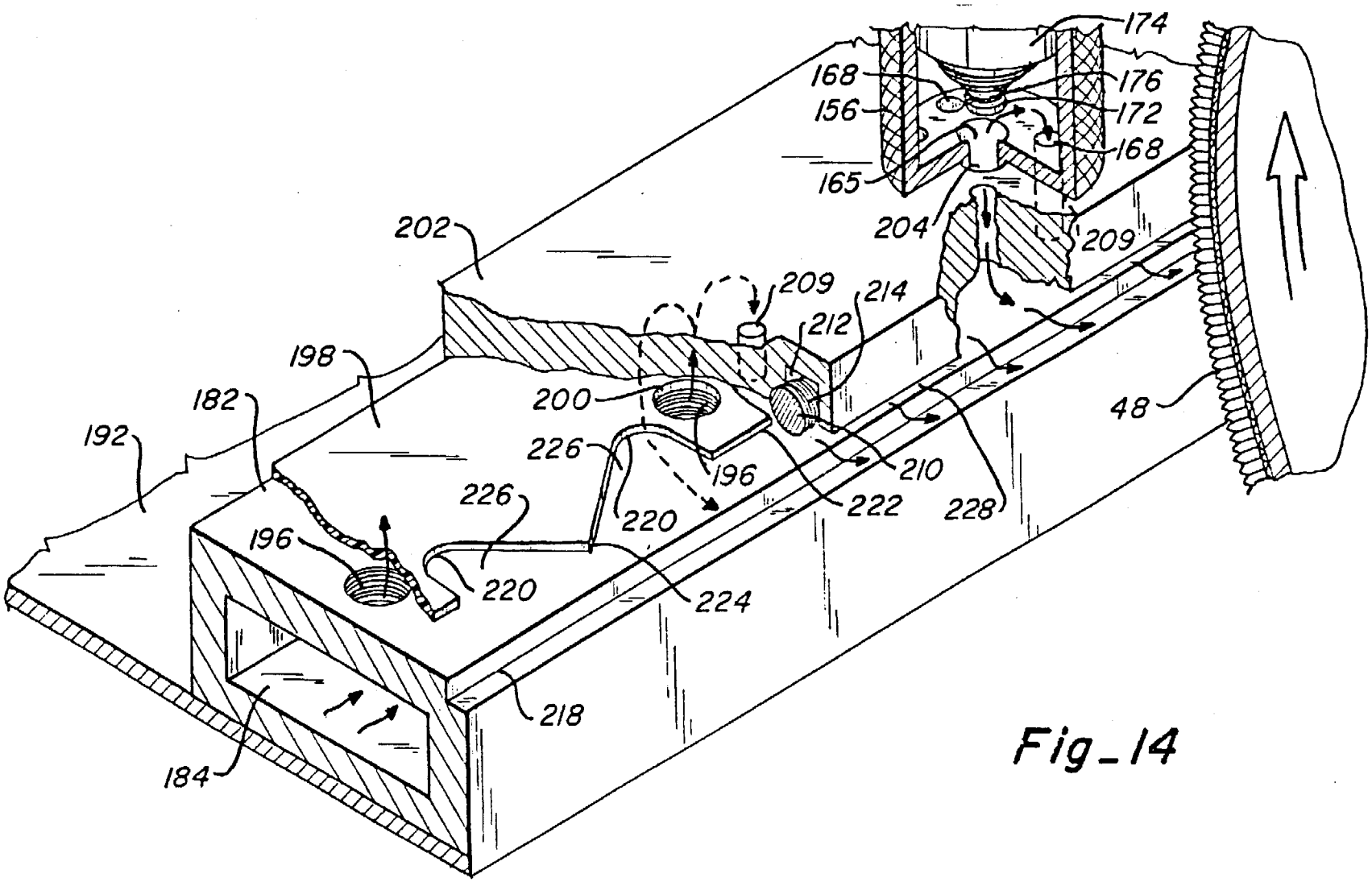
FIG. 14 is a greatly enlarged fragmentary, perspective view of the preferred embodiment with parts broken away to show further details of the invention.

The preferred embodiment of this invention is shown in FIGS. 12–16. A dispersion unit 180 is provided which includes a rectangular tubular bar 182 which has a central manifold 184, as best shown in FIG. 14. The opposite ends of manifold 184 are closed, as by end caps, such as end cap 186. An inlet opening 188 is provided in each end cap for introducing lane dressing fluid from a reservoir such as reservoir 56, shown in FIG. 2. A central opening or vent 190 is provided to purge air from the manifold when it is first filled with dressing fluid. Conveniently, dispersion unit 180 is mounted on a bracket 192, as by a mounting bolt 194 extending through bracket 192 into the bottom or base of bar 182. Advantageously, bar 182 has longitudinally spaced threaded openings 196 in its upper surface.

Figure 15:
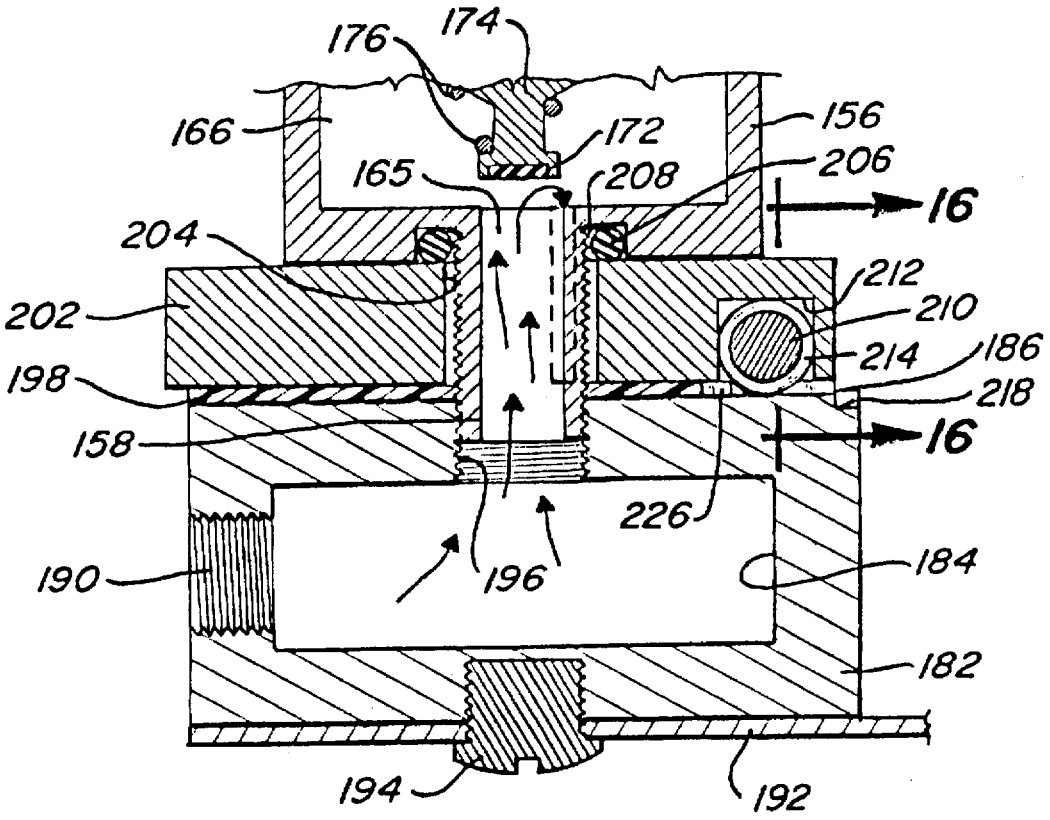
FIG. 15 is an enlarged vertical section, taken along line 15—15 of FIG. 12, showing the flow of the dressing fluid from the manifold through the pulse valve and through the dispersion chambers.

Laying longitudinally along the top of bar 182 is a dispersion gasket 198 which has openings 200 aligned with openings 196, as seen in FIGS. 13 and 14. Gasket 198 may be made of any suitable non-porous material which will not deteriorate over time due to contact with the dressing oil. An elongated cover plate 202 extends across dispersion gasket 198 and has openings 204 aligned with openings 196 and 200 through which the stem 158 of valve 156 extends, as shown in FIG. 15. As can be seen, the threads of stem 158 engage the threaded opening 196 in bar 182 and holds gasket 198 and cover plate 202 in place. To provide a complete seal an O-ring 206 is provided in a peripheral groove 208 around stem 158 and engages the top surface of plate 202 adjacent opening 200, as seen in FIG. 15. As can be seen in FIG. 14, when a valve 156 is energized so as to be moved to the open position shown, lane dressing fluid will flow from manifold 184 through central passageway 165 into chamber 166. From chamber 166, the dressing fluid will be directed downwardly through those openings 168 which are aligned with conduits 209 extending through top plate 202 to be dispersed as described below.

Just forward of dispersion gasket 198 extends a longitudinal dispersion member in the form of a dispersion rod 210 which is contained in a longitudinal groove or channel 212 in the lower surface of cover plate 202, as best seen in FIGS.

Figure 16:
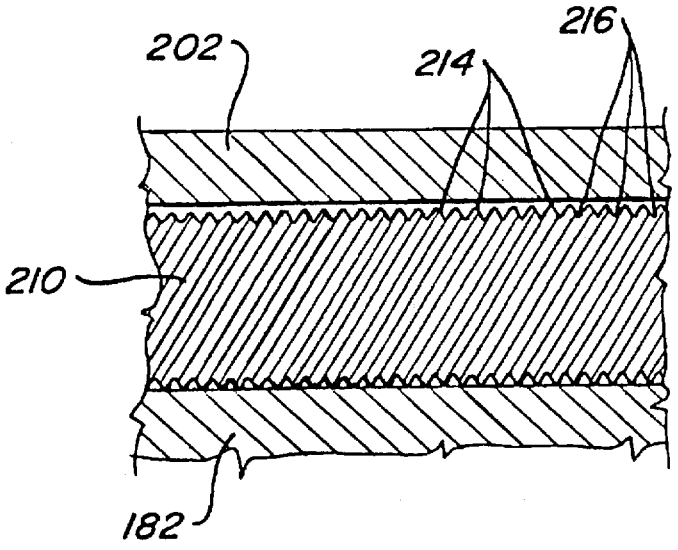
FIG. 16 is an enlarged fragmentary vertical section, taken along line 16—16 of FIG. 15, showing the baffle device for dispersing the fluid evenly through the outlet dispersion slit of the dispersion chamber.

14 and 15. As shown in FIG. 16, the dispersion rod 210 has peripheral ribs 214 forming grooves 216 therebetween.

Along the forward edge of bar 182 just forwardly of dispersion rod 210 is a cut or recess 218 for collecting lane dressing fluid and applying it to applicator 48.

Conveniently, when the valve is in the open position, fluid dressing will flow through conduits 209 into a curved recess 220 formed in the forward surface of the gasket 198. This recess terminates at one side in a flat surface 222 and at the other side in a pointed end or barrier 224. The dressing fluid dispensed into two adjacent recesses 220 will puddle forwardly from those recesses along the surface of the gasket and will ultimately merge with a puddle from an adjacent recess at barrier 224 or across edge 222. The space between each adjacent point 224 represents the width of one board of the bowling alley. It will be understood that the space between adjacent points 224 may be configured in any desired manner, for example, representing the width of multiple boards or partial widths of boards, in order to selectively apply fluid to any part of the bowling lane. Thus, different amounts of fluid can be dispensed between adjacent points to provide different amounts of fluid to each bowling alley board. As the fluid moves toward the leading edge, it will pass through dispersion rod 210 whose ribs 214 will further create an even flow of fluid into recess 218 where it is picked up by the applicator roller 48 and applied to the lane. The area between the adjacent pointed ends or barriers 224 of gasket 198 and above the upper surface of bar 182 form the respective dispersion chambers 226 from which fluid is dispensed into the recess 218 and onto applicator roller 48, as previously described. The forward edge of the space between adjacent tips 224 forms a slit 228 where the fluid is dispersed between the ribs 214 of dispersion rod 210. Ribs 214 serve as vertical baffles laterally spaced across outlet slits 228 of each dispersion chamber 226 for spreading the lane dressing for even discharge from the respective outlet slits. The longitudinal dispersion member may take forms other than that of dispersion rod 210. For example, dispersion rod 210 can be a screw having helical threads which form ribs and grooves for the same purpose. Also, a rod having integral knurls could be provided for the same purpose. Alternatively, the dispersion member could be formed as a thin web of dispersion gasket 198 extending between flat surface 222 and pointed end or barrier 224 which is serrated on its lower side to control the dispersion of the fluid as it passes therethrough. A helical spring could be provided in place of rod 210 wherein the edges of the spring would serve as vertical baffles providing the same dispersion characteristics. Finally, grooves could be provided in the upper edge of recess 218 for the same purpose. Thus, any arrangement of vertical grooves with intermediate baffles will serve as a dispersion means for spreading lane dressing for even discharge into longitudinal groove 218.

Although a separate pulse valve has been shown for each dispersion chamber, it will be understood that one pulse valve could serve a zone comprising more than one dispersion chamber, if desired, as will be apparent to one skilled in the art.

This invention has been described in detail with reference to particular embodiments thereof, but it will be understood that various other modifications can be effected within the spirit and scope of this invention.

I claim:

1. Apparatus for applying dressing fluid to boards of a bowling alley, said apparatus comprising:

an applicator;

an elongated bar disposed adjacent said applicator, said bar having an upper surface and a forward edge positionable for engagement with said applicator;

a plurality of side-by-side dispersion chambers formed along said bar, each chamber communicating with said forward edge; and an elongated cover plate extending over said upper surface of said bar and attached thereto, said forward edge of said bar and said plate forming an outlet slit means through which dressing fluid is dispersable onto said applicator.

2. Apparatus, as claimed in claim 1, wherein said outlet slit means comprises:

a plurality of outlet slits in contiguous side-by-side relationship so that a smooth pattern of dressing fluid is disperable onto the applicator.

3. Apparatus, as claimed in claim 2, wherein:

the number of said outlet slits is equal to the number of boards across the bowling alley; and each said outlet slit is the same width as the respective boards on the bowling alley.

4. Apparatus, as claimed in claim 1, further including:

a reservoir for supplying dressing fluid to said dispersion chambers;

separate pulse valves for a least some of said dispersion chambers, each pulse valve having an inlet and an outlet;

means interconnecting said inlet of each of said pulse valves to said reservoir for supplying dressing fluid from said reservoir to each of said pulse valves under pressure; and conduit means connecting said outlet of each of said pulse valves to said respective dispersion chambers.

5. Apparatus, as claimed in claim 4, wherein:

each of said pulse valves is mounted on said elongated cover plate and a portion thereof extends through said elongated cover plate and into said elongated bar for holding said elongated cover plate in fixed position on said elongated bar.

6. Apparatus, as claimed in claim 4, further including:

a controller connected to each of said pulse valves for activating each of them for a predetermined duty cycle.

7. Apparatus, as claimed in claim 4, wherein:

said interconnecting means includes a manifold.

8. Apparatus, as claimed in claim 7, wherein:

said manifold is mountable generally parallel to said elongated bar.

9. Apparatus, as claimed in claim 7, wherein:

said manifold is formed in said elongated bar.

10. Apparatus, as claimed in claim 1, wherein:

said elongated bar is in the form of a rectangular tube to provide a manifold for receiving the dressing fluid from a reservoir.

* * * * *